United States Patent [19]

Byrd, Jr.

[11] Patent Number: 4,549,382

[45] Date of Patent: Oct. 29, 1985

[54] FIBER BLANKET INSULATION MODULE

[75] Inventor: Carlisle O. Byrd, Jr., Houston, Tex.

[73] Assignee: Manville Service Corporation, Denver, Colo.

[21] Appl. No.: 475,855

[22] Filed: Mar. 16, 1983

[51] Int. Cl.[3] ..... E04B 1/80

[52] U.S. Cl. ..... 52/506; 52/508; 52/511; 24/511; 110/336; 248/221.3

[58] Field of Search ..... 52/506, 508, 509, 511, 52/711, 718; 248/221.3; 24/511, 658, 665; 110/331, 336, 338, 339

[56] References Cited

U.S. PATENT DOCUMENTS

| | | | |
|---|---|---|---|
| 3,350,832 | 11/1967 | Persson | 52/511 |
| 3,491,820 | 1/1970 | Ostling | 248/221.3 X |
| 3,640,033 | 2/1972 | Rijnders | 52/506 X |
| 3,703,794 | 11/1972 | Gracon et al. | 52/506 |
| 3,798,710 | 3/1974 | Tinnerman | 52/506 X |
| 3,849,954 | 11/1974 | Sugita | 52/506 X |
| 4,381,634 | 5/1983 | Hounsel et al. | 52/506 |
| 4,493,176 | 1/1985 | Cimochowski | 52/508 |

FOREIGN PATENT DOCUMENTS

| | | | |
|---|---|---|---|
| 2626973 | 12/1977 | Fed. Rep. of Germany | 52/511 |
| 2756127 | 6/1979 | Fed. Rep. of Germany | 52/506 |

*Primary Examiner*—Donald G. Kelly
*Assistant Examiner*—Richard E. Chilcot, Jr.
*Attorney, Agent, or Firm*—John D. Lister; Cornelius P. Quinn; Timothy R. Schulte

[57] ABSTRACT

An insulation module, for the interior of furnaces and the like, in the form of layers of ceramic fiber blanket is provided with attachment structure which facilitates installation. The attachment structure permits ease of installation and provides a perceptible indication once the module is properly attached to the furnace wall.

28 Claims, 10 Drawing Figures

FIBER BLANKET INSULATION MODULE

BACKGROUND OF INVENTION

1. Field of Invention

The present invention relates to modular refractory ceramic fiber blanket insulation systems.

2. Description of Prior Art

U.S. Pat. Nos. 3,952,470 and 4,001,996 each relate to modular refractory ceramic fiber blocks formed from folded ceramic fiber blankets for insulating furnaces and the like. In these modules, supporting rods were mounted within and extended along certain of the folds in the blankets. In the foregoing U.S. Patents, the modules were attached to the furnace wall by a channel member which extended transversely across the rear face of the insulation block in a direction transverse to the direction of the folds of the blanket of the block. Other U.S. Patents relating to insulation modules of which applicant is inventor are U.S. Pat. Nos. 4,055,926; 4,086,737; 4,103,469; and 4,122,386. These modules used channel attachment structure, as well. U.S. patent applications Ser. Nos. 245,946 and 309,594 of which applicant is an inventor are modules of similar blanket construction in which support rods penetrate the blanket near the folds adjacent the furnace wall rather than being mounted in alignment with the folds.

Another type of modules, such as in U.S. Pat. Nos. 3,819,468 and 3,832,815 has utilized wires or pins extending transversely through a number of aligned strips of "edge grain" ceramic fiber material or blanket to hold the strips together in the module. In U.S. Pat. No. 3,819,468, uncompressed strips of the blanket were mechanically attached to a board of material such as vermiculite which was then mechanically attached to the furnace shell. In U.S. Pat. No. 3,832,815 compressed strips of blanket were restrained on an inner surface or cold face by internal rods which attach to an expanded metal angle member at the sides were attached to the furnace wall.

Another type of furnace insulation, although not generally considered to be modules, impaled the insulative blanket onto spears or hangers generally parallel to the furnace walls. These spears were separate hardware items which has to be installed on the furnace wall in the field while the blanket was being attached, causing a more complicated installation, and also causing this type of insulation to not be regarded as modules. Examples of this type of insulation are in U.S. Pat. Nos. 3,854,262 and 3,892,396, and the insulation sold a "Nip & Tuck" insulation by C-E Refractories, Combustion Engineering, Inc. of Valley Forge, Pa. Also, in the "Nip & Tuck" type, the attachment structure used was such that insulation could not be removed independently of each other.

The impaled or speared blanket insulation was more difficult to install than modules, since handling of the individual blankets was required. This unduly increased labor costs and installation time. Also the impaled blanket was often not as strong as modular insulation. The "edge grain" modules typically required a special bolting or attaching tool, such as a stud welding gun, for installation against a furnace wall. Further, portions of the tool had to pass through the body of the module during installation. The prior art modules in which applicant is a named inventor offer advantages, among others, over the foregoing types of being easily manually installed by relatively unskilled persons onto washers or the like welded or bolted to the furnace wall.

In some situations, however, it has become desirable to achieve an even firmer and more positive attachment of the modules to the furnace wall. Additionally, it would be desirable to obtain an indication for the installer that this attachment has been achieved.

SUMMARY OF INVENTION

Briefly, the present invention provides a modular refractory ceramic fiber insulation system having a module of layers of refractory ceramic fiber blanket and structure for attaching the module to an inner surface, such as a wall, of a furnace or other high temperature equipment. The module has at least one support rod mounted in the blanket layers for support purposes.

The attaching structure includes a suspension arm member for receiving the support rod of the module, and mounting structure for attachment to the wall. Locking lug structure is provided for locking the suspension arm member to the mounting structure. The locking structure provides firm and positive engagement of the module with the wall. Also, the locking structure provides a perceptible indication to an installer that positive locking engagement has been obtained.

DESCRIPTION OF THE PREFERRED EMBODIMENT

Figure 5:
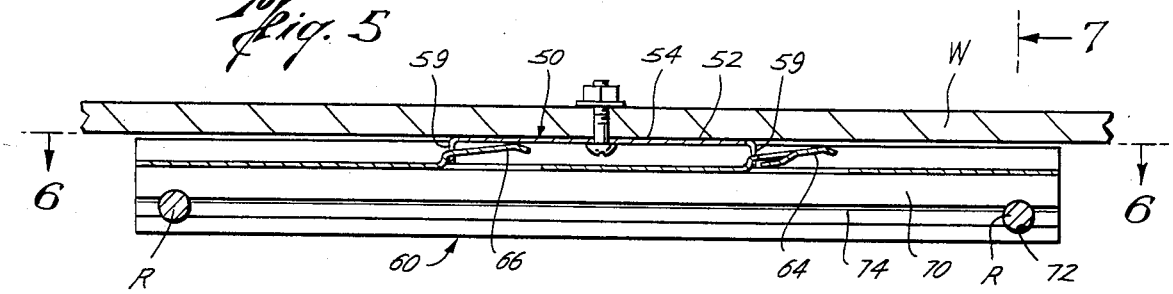
FIG. 5 is an elevation view, taken partly in cross-section, of attachment structure of another module of the present invention.
Figure 6:
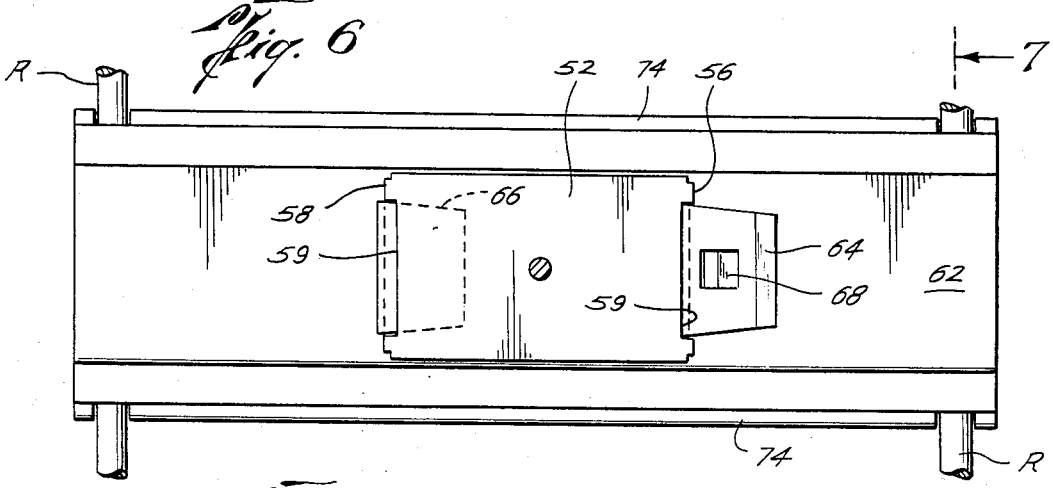
FIG. 6 is a cross-sectional view taken along the lines 6—6 of FIG. 5.
Figure 7:
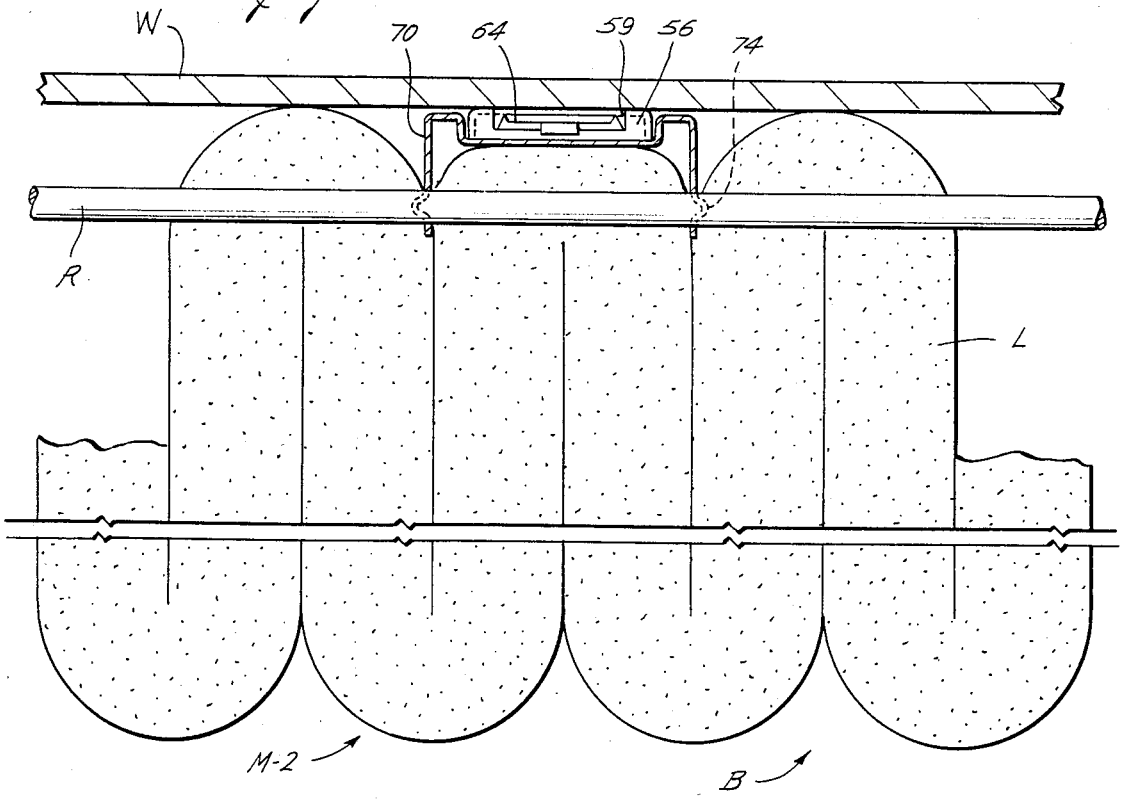
FIG. 7 is a cross-sectional view taken along the line 7—7 of FIG. 5.
Figure 8:
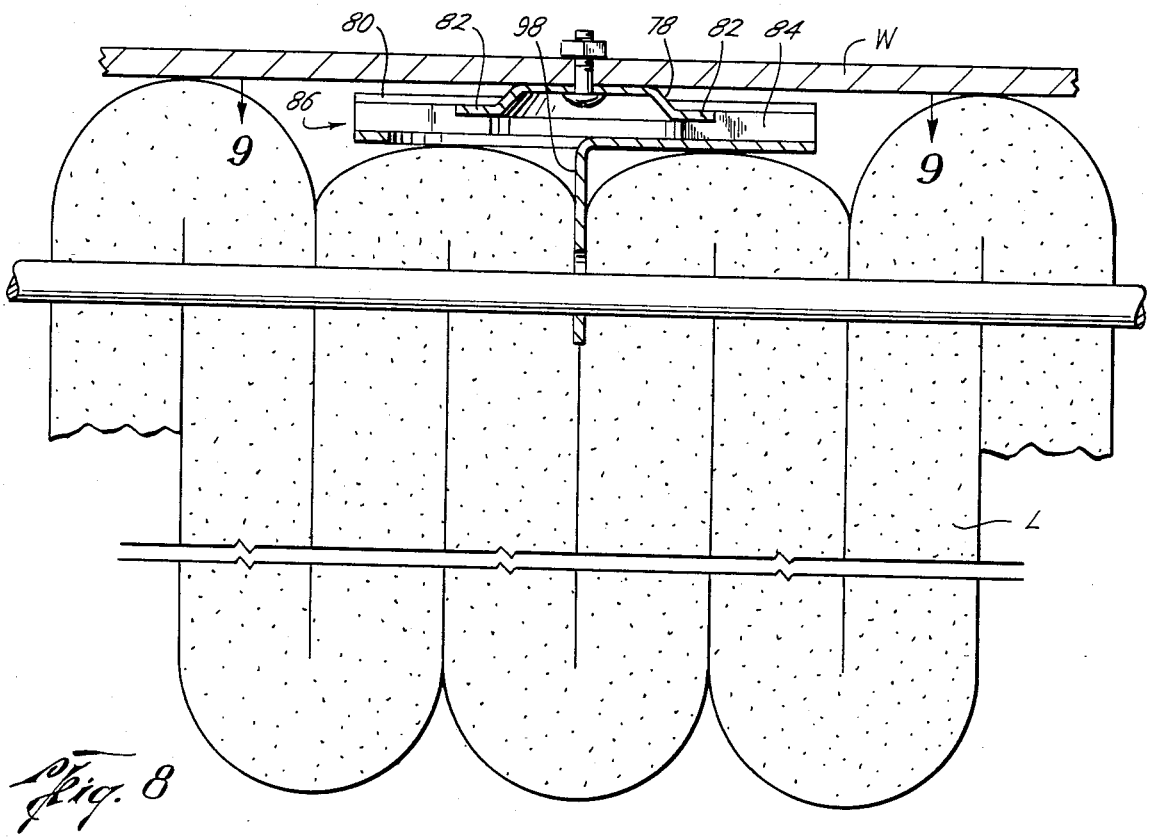
FIG. 8 is an elevation view, taken partly in cross-section, of another module of the present invention.
Figure 9:
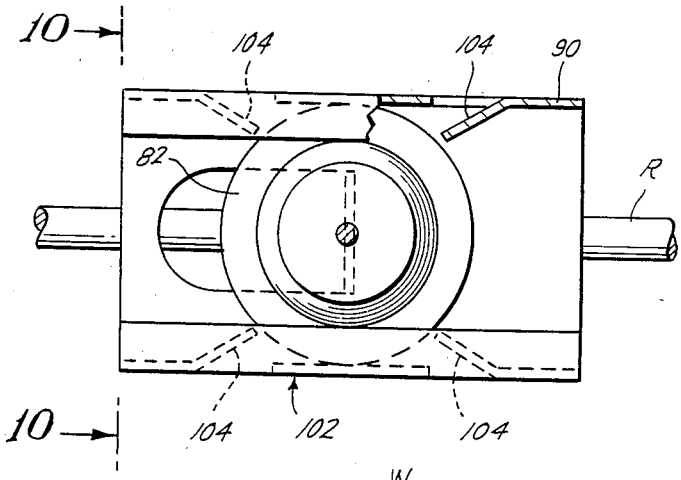
FIG. 9 is a cross-sectional view, partially broken away, taken along the lines 9—9 of FIG. 8.
Figure 10:
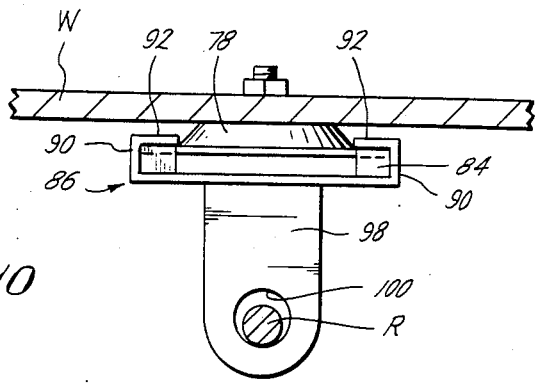
FIG. 10 is a cross-sectional view taken along the lines 10—10 of FIG. 9.

In the drawings insulation modules according to the present invention for lining a wall W, which may either be a side wall or a roof of a furnace or some other high temperature equipment, such as soaking pits, annealing furnaces, ladle pre-heaters, stress relieving furnaces and the like is set forth. Modules according to the present invention may take several forms, such as a module M-1 (FIGS. 1 through 4, inclusive), a module M-2 (FIGS. 5 through 7, inclusive), and a module M-3 (FIGS. 8 through 10, inclusive).

In each of the modules of the present invention, a block B of refractory ceramic fiber blanket L is supported by one or more support rod means R which are attached to the wall W by attachment structure of the present invention. The support rods R may be of the type extending through the block L in a direction transverse the layers of the blanket, as set forth in U.S. patent applications Ser. Nos. 245,946 and 309,594 discussed above. The support rods R may also be positioned to pass beneath and support rods of the type extending along folds in the folded blankets, as in U.S. Pat. Nos. 3,952,470 and 4,001,996.

The blanket B may be formed of layers folded into serpentine fashion, as in U.S. Pat. No. 4,001,996, extending between a hot face 20 exposed to interior conditions of the furnace and a cold face 22 or inner surface adjacent the wall W. The blocks B may be of the form of layers formed into a number of U-shaped folded members as in U.S. Pat. No. 3,952,470 as well. Additionally, if the support rods R extend transverse the layers, the blocks B may be of the edge grain type if desired. For insulating electrical furnaces, the blocks B may be of the type receiving electrical elements such as those in U.S. patent application Ser. No. 202,360.

In the module M-1 the attachment structure includes a mounting means 24 in the form of a mounting plate 26 conforming to the flatness or curvature of the wall W and adapted to be welded or bolted on an upper surface 28 (FIG. 2) to the wall W. The mounting means 24 further includes an attachment lug 30 formed extending transversely at one end from the plate 26 inwardly from the wall W. An insertion slot 32 is formed in the attachment lug 30 for receipt of an insertion tab 34 of a locking lug 36. In the module M-1, the locking lug 36 and suspension arm 38 are formed from a single structural member made of a suitable strength metal, such as stainless steel. The support arm member has a support opening 40 formed therein for receipt of the support rod R.

Figure 1:
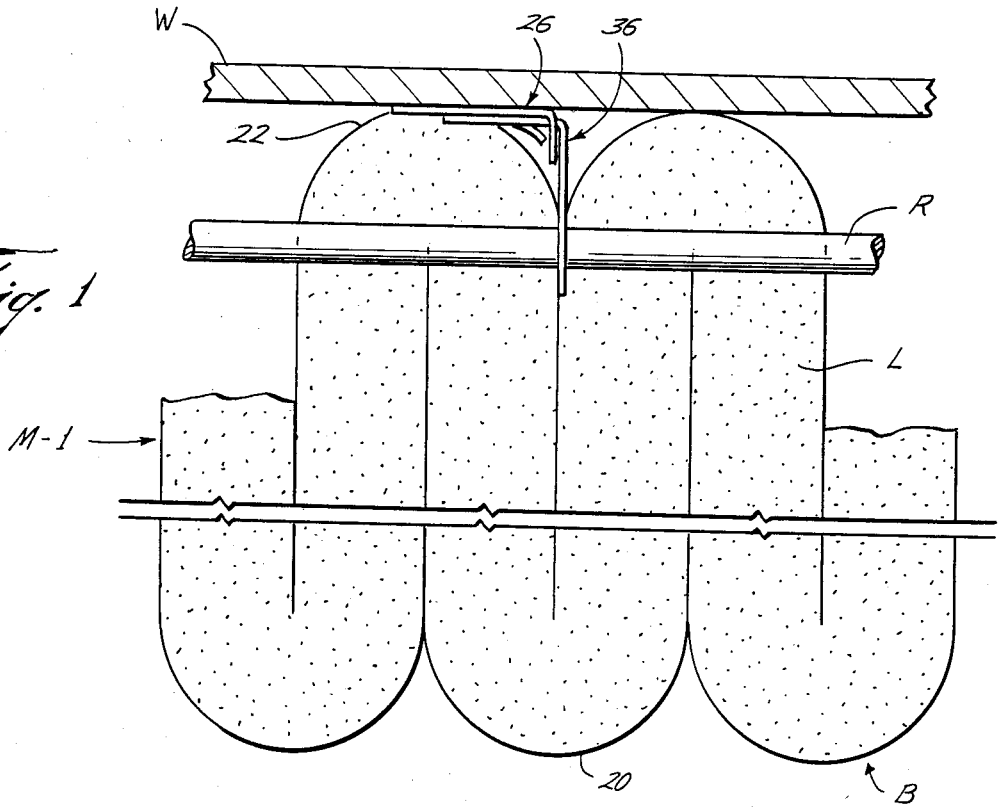
FIG. 1 is an elevation view, taken partly in cross-section, of a module of the present invention installed on a wall of a furnace.
Figure 2:
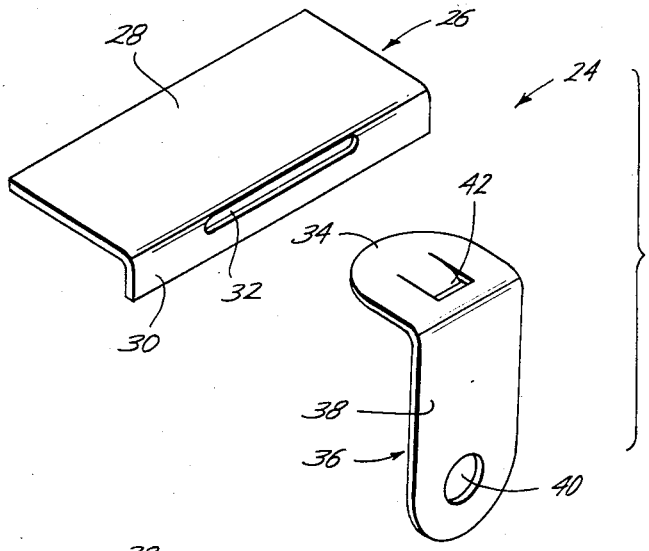
FIG. 2 is an exploded isometric view of a portion of the structure of FIG. 1.
Figure 3:
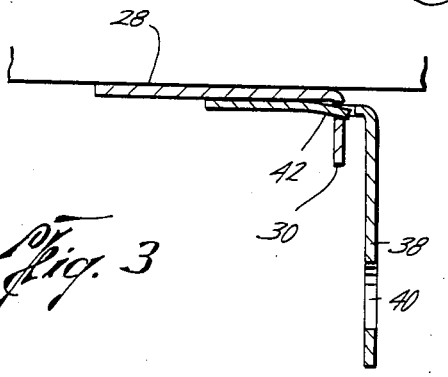
FIGS. 3 and 4 are cross-sectional elevation views of portions of the structure of FIG. 1.
Figure 4:
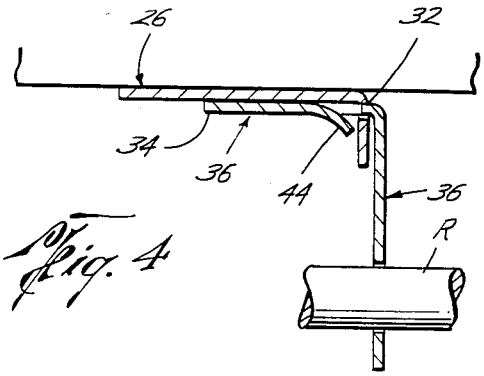

The locking lug 36 of the module M-1 includes a resilient locking tongue 42 stamped or punched to extend downwardly in a curving manner from the insertion tab 34 (FIG. 4). The locking tongue 42 is adapted to be moved into a substantially flat position conforming to the shape of the insertion tab 34 as the tab 34 passes into the insertion slot 32 (FIG. 3). A rear portion 44 of resilient locking tongue 42 snaps, however, downwardly (FIG. 4) to its original position once the locking tab 34 has been moved through the insertion slot 32. In this manner, interlocking engagement is formed by the locking lug 36 between the mounting means 24 and the support arm member 38.

Mounting plates 26 are bolted as welded in rows across the wall W to be insulated. Individual ones on the blocks B are then moved so that the insertion tab 34 is aligned with insertion slot 32. Tab 34 is then moved into the slot 32 by moving the block B towards mounting plate 26 in the direction that the rods R extend through the block. Locking tongue 42 is depressed (FIG. 3) on entry into the slot 32 until rear portion 44 clears the slot 32. Tongue 42 then snaps downwardly (FIG. 4), locking the block B to the wall W. This movement of tongue 42 is perceptible to an installer by feel and often by hearing.

In the module M-2 (FIGS. 5 through 7, inclusive), the attachment structure includes a mounting means 50 in the form of a substantially flat mounting plate 52 adapted to be welded or bolted on an upper surface 54 to the wall W. The mounting means 50 further includes attachment lugs 56 and 58 formed extending transversely from the plate 52 inwardly at opposite sides thereof. Insertion slots 59 are formed in each of the attachment lugs 56 and 58 for engagement with locking lug structure formed with a channel member 60.

The channel member 60 has a center upper wall plate 62 from which insert tabs 64 and 66 are punched or stamped or otherwise formed to extend upwardly therefrom. At least one of the insert tabs 64 and 66 has a locking tongue 68 formed extending therefrom. Preferably only one of the insert tabs 64 and 66 has a locking tongue 68, for reasons to be set forth.

Mounting arms 70 are formed on opposite sides of the wall plate 62 of the channel member 60 extending inwardly therefrom. Each of the mounting arms 70 has plural support openings 72 formed therein at spaced positions for receipt of support rods R in the block B. Further, reinforcing ribs 74 are formed on the mounting arms 70 in the vicinity of the support openings 72 for reinforcement purposes.

Installation of the module M-2 proceeds much on the order of the module M-1, except that the block B is slid transversely onto the mounting plate 50 with respect to the direction of extent of rods R in the block B. Care must be taken that each of the insert tabs 64 and 66 is aligned with one of the insertion slots 59 before insertion. Otherwise, a first of the locking tongues 68 might lock with one of the attachment lugs in such a manner that the other locking tongue cannot be brought into contact with the mounting plate 52. For prevention of this type of alignment, preferably only one of insert tabs 64 and 66 is formed with a locking tongue 68.

In a module M-3 of the present invention, a mounting means 78 in the form of a washer or disk is attached to the wall W by means of welding or bolting thereto. The washer or mounting means 78 has outwardly extending rim portions 82 formed thereon for insertion into slots 84 formed in a slide channel member 86 of the mounting means 78 of the module M-3. The slide channel 86 includes a center plate 88 and connecting arms 90 extendingly upwardly therefrom to inwardly extending support arms 92 which engage the outer portions 82 of the washer 80 and support the module M-3 from the wall W.

In the module M-3, a suspension arm member 98 is formed by being pressed or stamped downwardly at a mid portion of the center plate 88. A support opening 100 is formed in the suspension arm 98 for receiving the support rod R. In the module M-3, locking means 102 in the form of a plurality of locking tongues 104 are formed by being punched or stamped inwardly from the connecting arms 90, with the locking tongues 104 pointing inwardly towards the mid-portion of center plate 88 adjacent suspension tab 98. In this manner, the slide channel member 86 may be moved with respect to the washer 80 in either direction until the outer portions 82 of washer 80 pass into the space in the slide channel member 86 located between the inwardly pointing locking tongues 104. In this manner, the locking tongue members 104 permit sliding movement of the attachment washer 80 into a position centrally located with respect to the suspension tab 98 thereabove and situated with respect to the inwardly extending locking tongue 104 so that movement of the washer 80 out of the slide channel member 86 is inhibited or blocked. In this manner, the locking tongue members 104 lock the suspension arm member 98 to the mounting washer 80 and attached the module M-3 to the wall W.

In installing modules of the present invention, these modules may be prefabricated, with the support rods R inserted into the suspension or mounting arms at the factory, or the rods R and suspension arms may be installed in the blocks B at a job site. The mounting plates or mounting members associated with the blocks being installed are then bolted or welded to the furnace interior wall or surface. The locking lug structure of the particular module is then used to lock the suspension arm member to the mounting plate in the manner set forth above, attaching the insulation module to the wall. The locking lug structure of the modules of the present invention is such that an installer has a perceptible indication, usually in the form of sensing the mechanical snapping of the locking structure as the locking function takes place. This perception is normally conveyed by means of feel or touch in the installer's hands. In certain situations, where background noise is relatively low, the locking snap of the locking lug into place may even be heard.

The foregoing disclosure and description of the invention are illustrative and explanatory thereof, and various changes in the size, shape and materials, as well as in the details of the illustrated construction may be made without departing from the spirit of the invention.

I claim:

1. In an apparatus for attaching a module of refractory fiber blanket to a surface such as a furnace wall, said apparatus including at least one support rod suspended in said module by a suspension arm member means adapted to receive said support rod, and means, attached to said surface, for mounting said module, the improvement comprising:

at least one locking tongue cooperative with said suspension arm member means and said mounting means for locking said suspension arm means to said mounting means upon slideable engagement thereof.

2. The apparatus of claim 1, wherein said mounting means comprises:

(a) a wall mounting plate member adapted for connection to the wall;

(b) attachment lug means extending transversely to said mounting plate;

(c) said attachment lug means having an insertion slot formed therein for receipt of said locking tongue.

3. The apparatus of claim 2, wherein:

said suspension arm member means has a support opening formed therein for receiving the support rod of the module.

4. The apparatus of claim 2, wherein:

said suspension arm member means has a plurality of support openings formed therein for receiving the support rods of the module.

5. The apparatus of claim 2, wherein said attachment lug means comprises:

an attachment lug formed at one end of said wall mounting plate member.

6. The apparatus of claim 2, wherein said attachment lug means comprises:

an attachment lug formed on each side of said wall mounting plate member.

7. The apparatus of claim 6, wherein:

said suspension arm member means has a plurality of support openings formed therein for receiving support rods of the module.

8. The apparatus of claim 6, further including:

reinforcing ribs formed on said suspension arm member means.

9. The structure of claim 6, wherein each of said attachment lugs has insertion slots formed therein.

10. The apparatus of claim 9, wherein said suspension arm member means comprises:

(a) a plurality of insertion tabs, each adapted for movement into a corresponding one of said insertion slots;

(b) at least one of said insertion tabs including said locking tongue formed in said insertion tab;

(c) said locking tongue being resilient and adapted for movement into substantial conformity with said insertion tab during movement into said insertion slot; and (d) said resilient locking tongue being adapted for movement into locking position with said mounting means.

11. The apparatus of claim 2, wherein said suspension arm member means comprises:

(a) an insertion tab adapted for movement into said insertion slot;

(b) said locking tongue formed in said insertion tab;

(c) said locking tongue being resilient and adapted for movement into substantial conformity with said insertion tab during movment into said insertion slot; and (d) said resilient locking tongue being adapted for movement into locking position with said mounting means.

12. The apparatus of claim 1, wherein said mounting means comprises:

(a) an attachment member adapted for connection to the wall;

(b) a slide channel having slots formed therein for receiving said attachment member and permitting relative sliding movement therebetween.

13. The apparatus of claim 12, wherein said locking tongue comprises:

extends into said slide channel slots to permit sliding movement of said attachment member therepast in one direction while blocking reverse sliding movement of said attachment member.

14. The apparatus of claim 12, wherein said suspension arm member is formed extending transversely from said slide channel.

15. A refractory ceramic fiber blanket module for insulating an inner surface, such as a wall, of a furnace or the like, comprising:

(a) an inner surface portion exposed along an insulation surface to the interior of the furnace;

(b) an outer surface portion adapted to be mounted against the wall;

(c) a block formed of layers of refractory ceramic blanket material extending between said inner and outer surface portions;

(d) at least one support rod mounted in said layers to support said blanket in place on the wall;

(e) suspension arm member means for receiving the support rod of the module therein;

(f) mounting means for attachment to the wall; and (g) resilient tongue means for locking said suspension arm member means to said mounting means to attach the insulation module to the wall.

16. The module of claim 15, wherein said mounting means comprises:

(a) a wall mounting plate member adapted for connection to the wall;

(b) attachment lug means extending transversely to said mounting plate;

(c) said attachment lug having an insertion slot formed therein for receipt of said locking tongue.

17. The module of claim 16, wherein:

said suspension arm member means has a support opening formed therein for receiving the support rod of the module.

18. The module of claim 16, wherein:

said suspension member means has a plurality of support openings formed therein for receiving the support rods of the module.

19. The module of claim 16, wherein said attachment lug means comprises:

an attachment lug formed at one end of said wall mounting plate member.

20. The module of claim 16, wherein said attachment lug means comprises:

an attachment lug formed on each side of said wall mounting plate member.

21. The module of claim 20, wherein:

each of said suspension arm member means has a plurality of support openings formed therein for receiving support rods of the module.

22. The module of claim 20, further including:

reinforcing ribs formed on said attachment lugs.

23. The module of claim 20, wherein each of said attachment lugs has insertion slots formed therein.

24. The module of claim 23, wherein said suspension arm member means comprises:

(a) a plurality of insertion tabs, each adapted for movement into a corresponding one of said insertion slots;

(b) at least one of said insertion tabs including said locking tongue formed in said insertion tab;

(c) said locking tongue being resilient and adapted for movement into substantial conformity with said insertion tab during movement into said insertion slot; and (d) said resilient locking tongue being adapted for movement into locking position with said mounting means.

25. The module of claim 16, wherein said suspension arm member means comprises:

(a) an insertion tab adapted for movement into said insertion slot;

(b) said locking tongue formed in said insertion tab;

(c) said locking tongue being resilient and adapted for movement into substantial conformity with said insertion tab during movement into said insertion slot; and (d) said resilient locking tongue being adapted for movement into locking position with said mounting means.

26. The module of claim 15, wherein said mounting means comprises:

(a) an attachment member adapted for connection to the wall;

(b) a slide channel having slots formed therein for receiving said attachment member and permitting relative sliding movement therebetween.

27. The module of claim 26, wherein said locking tongue means comprises:

locking tongue members formed extending into said slide channel slots to permit sliding movement of said attachment member therepast in one direction while blocking reverse sliding movement of said attachment member.

28. The apparatus of claim 26, wherein said suspension arm member is formed extending transversely from said slide channel.

* * * * *

UNITED STATES PATENT AND TRADEMARK OFFICE

CERTIFICATE OF CORRECTION

PATENT NO. : 4,549,382

DATED : October 29, 1985

INVENTOR(S) : Carlisle O. Byrd, Jr.

It is certified that error appears in the above—identified patent and that said Letters Patent is hereby corrected as shown below:

Column 7, Line 6, after "suspension" insert --arm--;

Column 7, Line 23, delete "attachment lugs" and insert therefore --suspension arm member means--.

Signed and Sealed this

*Tenth* Day of *June 1986*

[SEAL]

*Attest:*

DONALD J. QUIGG

*Attesting Officer*

*Commissioner of Patents and Trademarks*